United States Patent [19]

Seabaugh

[11] Patent Number: 4,836,088

[45] Date of Patent: Jun. 6, 1989

[54] DIRECTIONAL CONTROL VALVE AND REGENERATION VALVE

[75] Inventor: David T. Seabaugh, Goose Creek, S.C.

[73] Assignee: Rome Industries, Inc., Cedartown, Ga.

[21] Appl. No.: 767,764

[22] Filed: Aug. 21, 1985

[51] Int. Cl.[4] ..... F15B 11/08

[52] U.S. Cl. ..... 91/436; 91/461; 91/526; 91/529; 91/530

[58] Field of Search ..... 91/436, 437, 438, 508, 91/521, 522, 525, 526, 529, 530, 459, 461; 60/484

[56] References Cited

U.S. PATENT DOCUMENTS

| | | | |
|---|---|---|---|
| 3,227,050 | 1/1966 | Hein | 91/438 |
| 3,512,453 | 5/1970 | Balzer | 91/526 |
| 3,759,144 | 9/1973 | Ikeda | 91/436 |
| 3,851,566 | 12/1974 | Herrmann | 91/526 |
| 3,854,380 | 12/1974 | Casey | 91/521 |
| 3,935,792 | 2/1976 | DeZelan | 91/438 |
| 4,128,380 | 12/1978 | Jamann | 91/438 |
| 4,216,702 | 8/1980 | Brundidge | 91/436 |
| 4,421,135 | 12/1983 | Harshman et al. | 91/522 X |
| 4,638,720 | 1/1987 | McKee et al. | 91/529 |
| 4,702,148 | 10/1987 | Kussel et al. | 91/529 X |

*Primary Examiner*—Edward K. Look

*Attorney, Agent, or Firm*—Hurt, Richardson, Garner, Todd & Cadenhead

[57] ABSTRACT

An hydraulic system for operating double acting piston/cylinder assemblies and for effecting automatic transition from a regenerative mode of operation of a double acting piston/cylinder assembly to a non-regenerative mode of operation thereof. Pressure responsive valve means automatically converts the hydraulic system from one initially being a high-speed/low force operation to a high force/low speed operation.

14 Claims, 10 Drawing Sheets

DIRECTIONAL CONTROL VALVE AND REGENERATION VALVE

BACKGROUND OF THE INVENTION

1. Field of the Invention

The invention relates to hydraulic systems for supplying and controlling pressurized fluid and drain to one or more double acting piston-cylinder assemblies. The invention also relates to means for automatically transposing from a regenerative to a non-regenerative flow with respect to a double acting piston-cylinder assembly.

2. Prior Art

Insofar as the prior art relates to flow control systems which serve a plurality of double acting piston-cylinder assemblies under manual control of an operator by means of a control valve lever and switches which may be mounted on the operator's stalk, the closest prior art known is the Balzer U.S. Pat. No. 3,512,453, noting particularly column 2 at lines 61–64. Other patents of interest are U.S. Pat. Nos. 4,244,405; 3,854,380; 3,705,631; and 3,589,242.

Insofar as the prior art relates to systems which automatically transpose from regenerative to non-regenerative flow, the closest prior art known is the Haarmeyer U.S. Pat. No. 2,800,110. Other patents of interest are the Ikeda U.S. Pat. No. 3,759,144; the Friesen et al. U.S. Pat. No. 4,397,221; the Brundidge et al. U.S. Pat. No. 4,216,702; the Christensen et al. U.S. Pat. No. 3,643,696; the Rice U.S. Pat. No. 3,335,739; and the Hall et al. U.S. Pat. No. 4,152,970.

BRIEF SUMMARY OF THE INVENTION

This invention relates to hydraulic systems for operating double acting piston/cylinder assemblies and is concerned in one embodiment with hydraulic circuitry for effecting automatic transition from a regenerative mode of operation of a double acting piston/cylinder assembly to a non-regenerative mode of operation thereof.

The non-regenerative mode is characterized by the fact that it is automatically effected by a hydraulic condition which abruptly connects the rod end of the piston/cylinder assembly to hydraulic drain pressure while the base end of the assembly remains directly connected to the hydraulic pressure fluid supply. In this way, substantially full hydraulic power is applied in the non-regenerative mode of operation, without back pressure at the rod end of the assembly.

The hydraulic circuitry by which the automatic transition is made possible is characterized by its simplicity of construction and includes the provision of full hydraulic pressure supply to the base end of the piston/-cylinder assembly prior to, during and subsequent to the transition.

In another embodiment, this invention is concerned with hydraulic circuitry in which manual control means is provided to control a central control unit so that the operator may select to supply and control one of a plurality of hydraulic circuits from a common hydraulic supply source, each of the circuits including a double acting piston/cylinder assembly. In this aspect, the aforesaid automatic transition from regenerative mode to non-regenerative mode may be incorporated within the central control unit of the invention to operate in a single one or any combination of the selected circuits.

The control for selection of the desired piston/cylinder assembly to be operated is characterized by its simplicity of construction, including the provision of a pilot fluid pressure line and a pilot fluid drain line and solenoid operated valve means for connecting the pilot fluid pressure line with the pilot fluid drain line so as to operate at least one directional control valve which effects the selection of the piston/cylinder assembly to be actuated.

In one aspect, then, the invention relates to an improved circuitry for automatically effecting transition from regenerative mode to non-regenerative mode in a simple and efficient manner. With regard to this, between the operator-controlled valve and the piston/cylinder assembly, first path means is provided which directly connects one outlet of the controlled valve to the base end of the piston/cylinder assembly in those positions of the valve in which such one outlet respectively provides pressurized fluid to the base end and connects it to drain. Second flow path means connects the other or second outlet of the controlled valve to the rod end of the piston/cylinder assembly for normally blocking fluid flow from the rod end of the assembly when the second outlet is connected to drain and for allowing flow from the second outlet to the rod end of the assembly when the second outlet is connected to pressure fluid. A third flow path means is provided to connect the rod end to the base end for allowing pressurized fluid flow from the rod end to the base end to effect the regenerative mode of operation. The second flow path means includes pressure responsive valve means for dumping the rod end to drain in response to attainment of a set pressure at the rod end of the assembly, therby effecting the automatic transition from regenerative to non-regenerative mode of operation.

BRIEF DESCRIPTION OF THE DRAWING FIGURES

Figure 1:
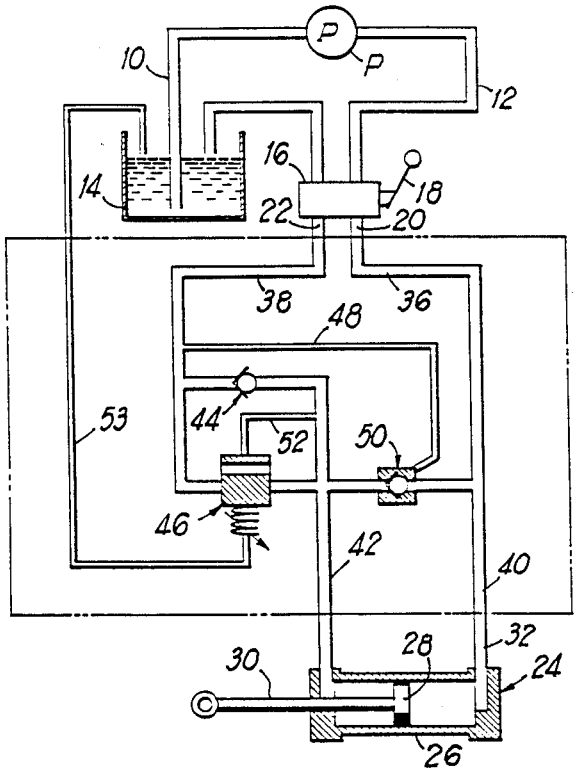
FIG. 1 is a diagrammatic view illustrating one embodiment of the invention.
Figure 4:
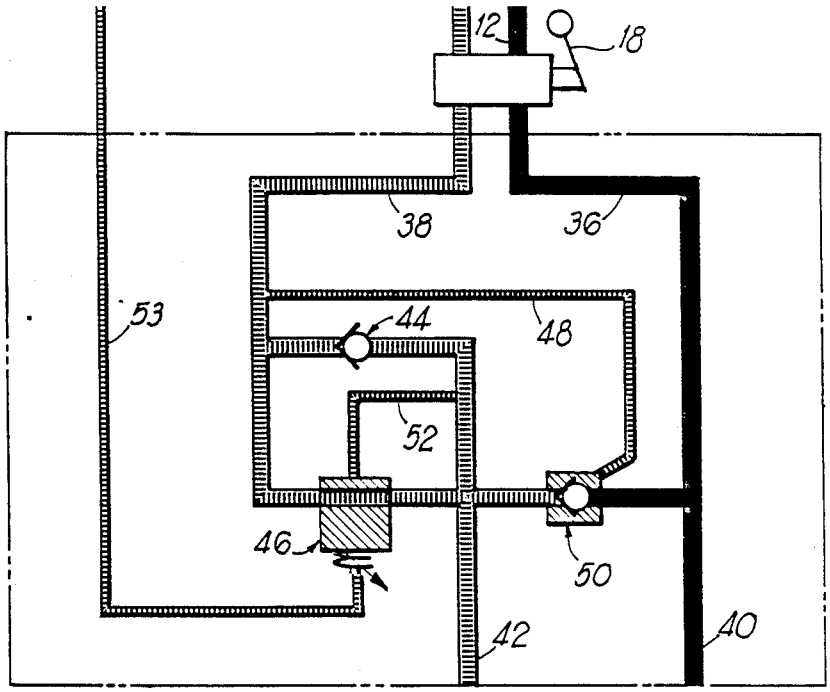
Figure 5:
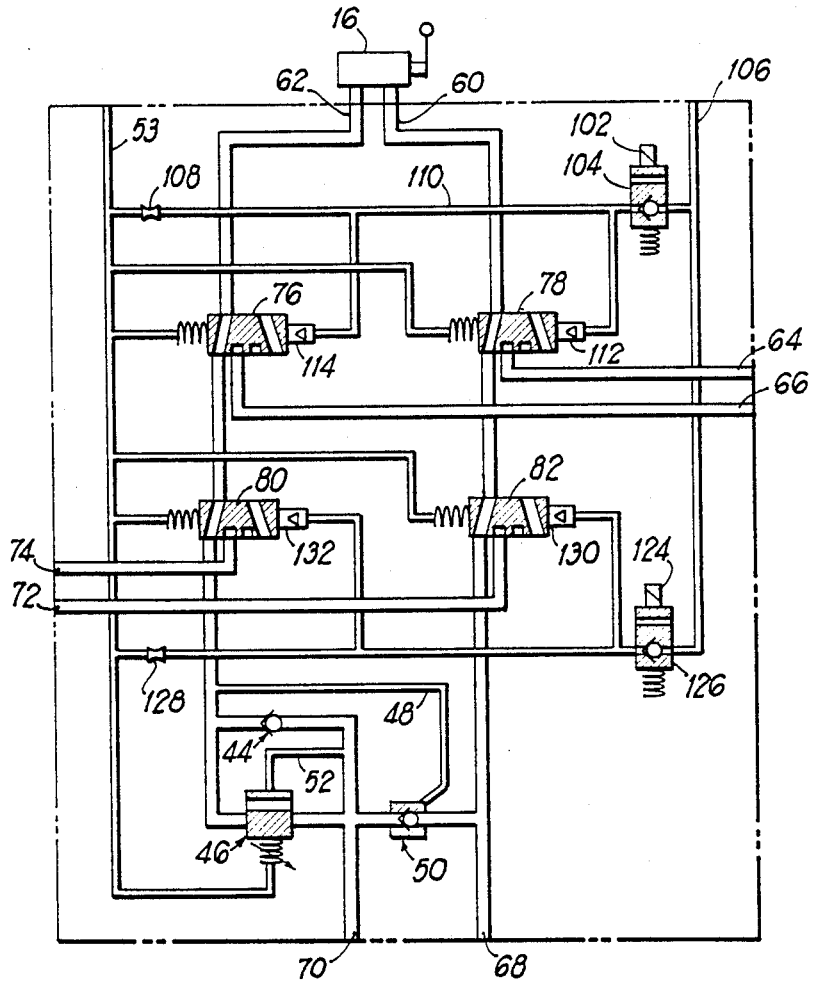
Figure 6A:
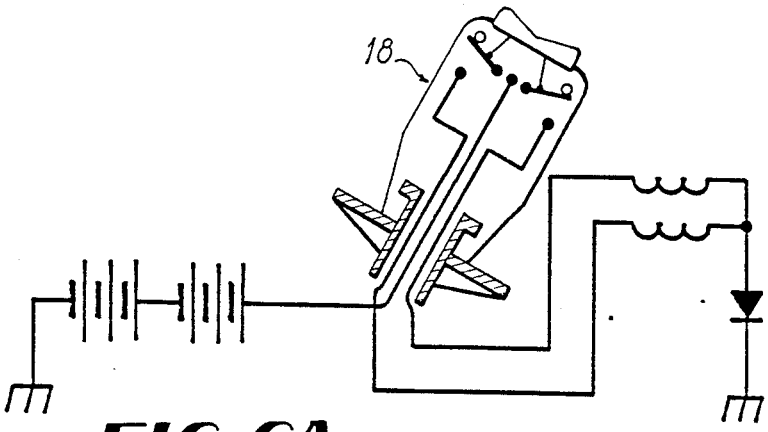
Figure 6:
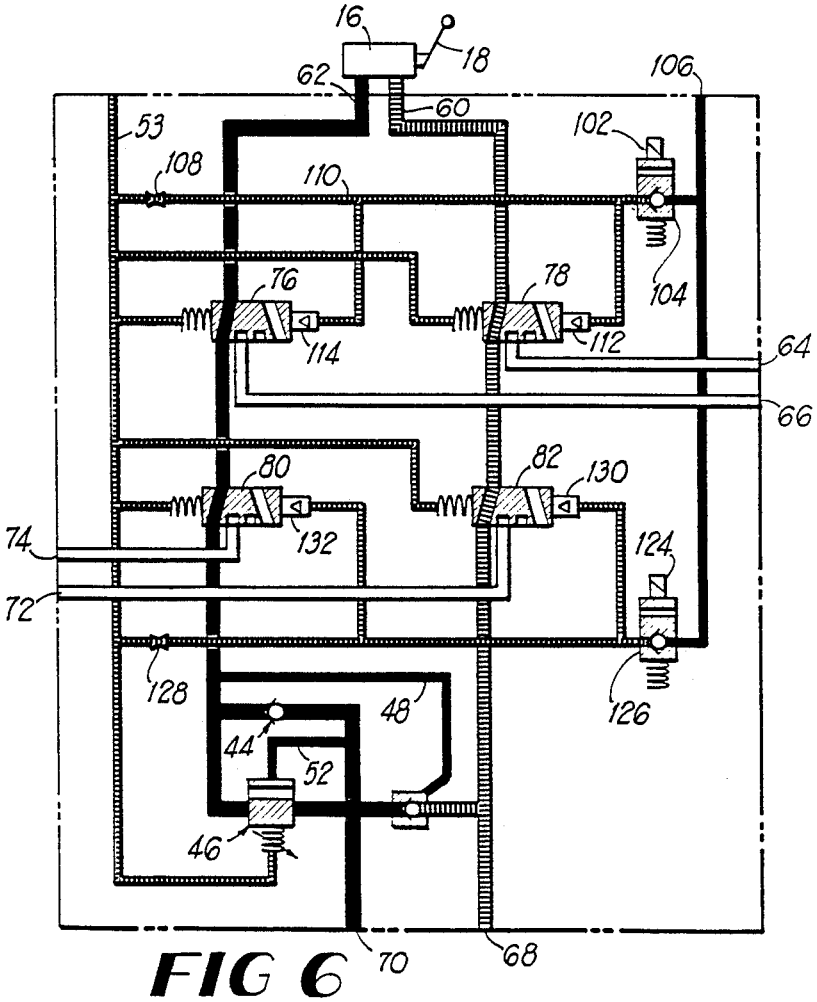
Figure 7A:
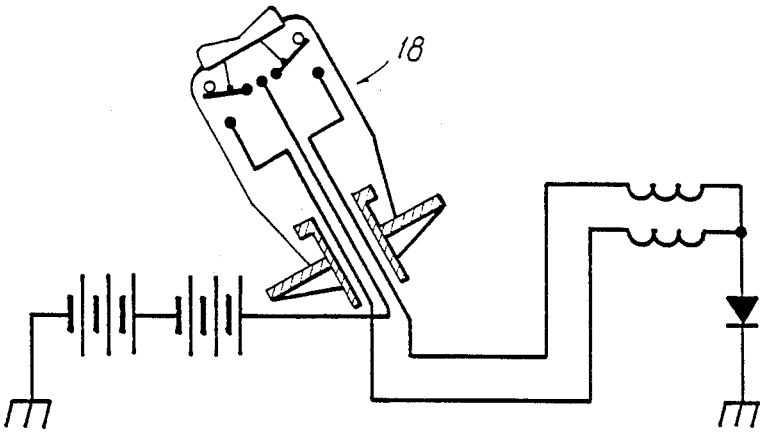
Figure 7:
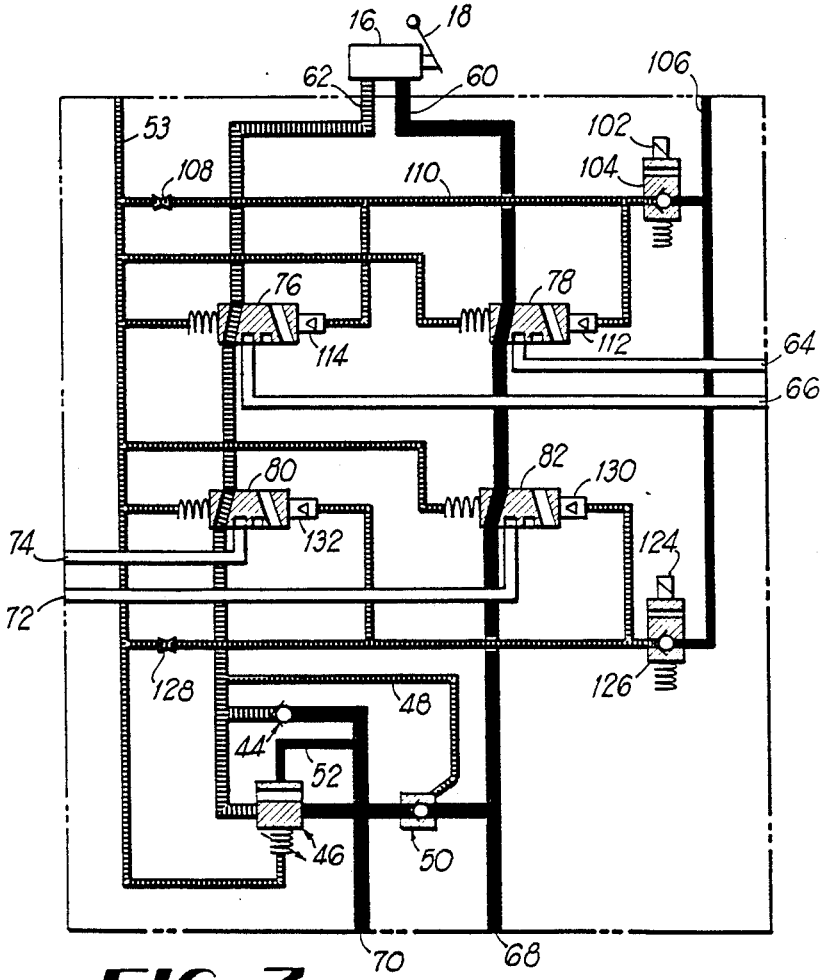
Figure 8A:
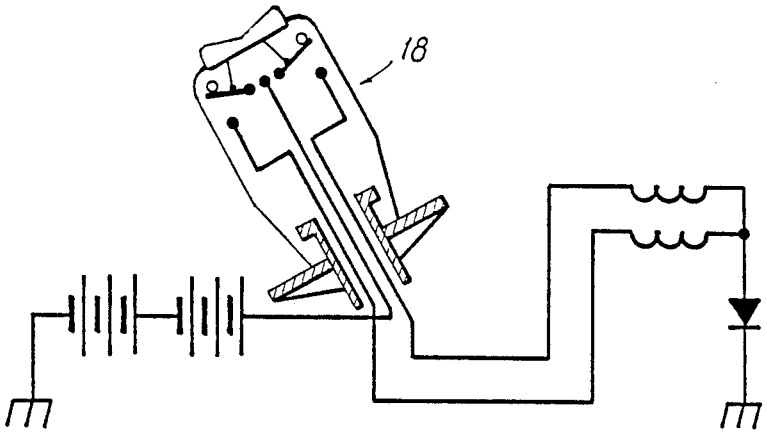
Figure 8:
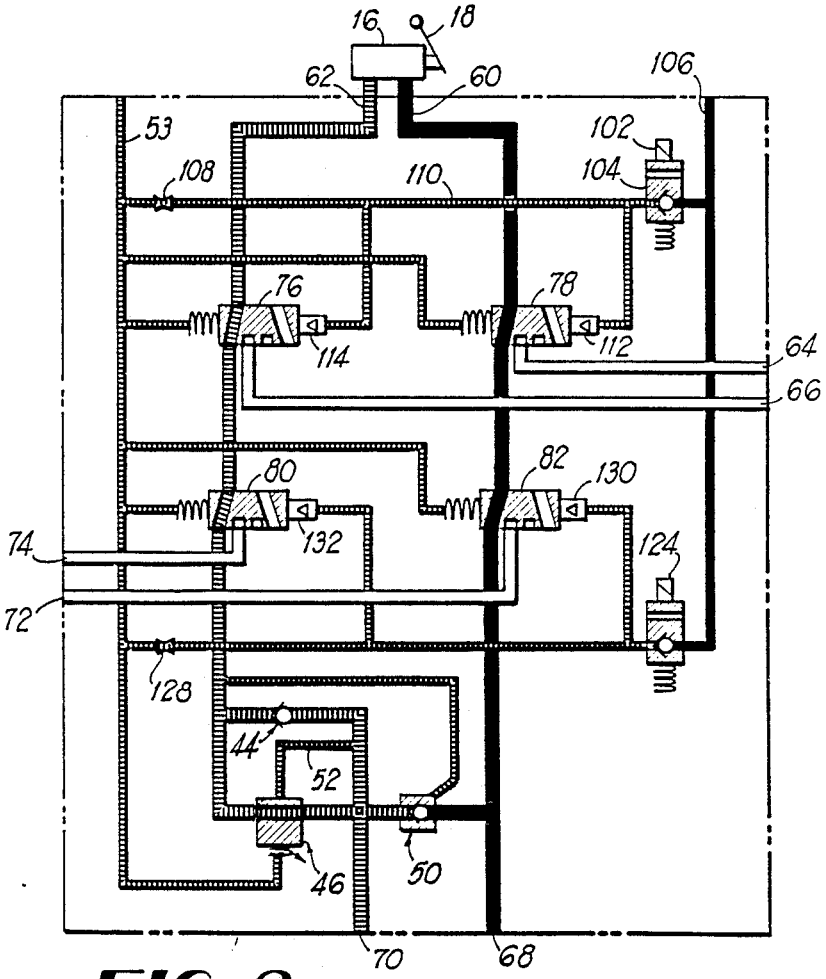
Figure 9A:
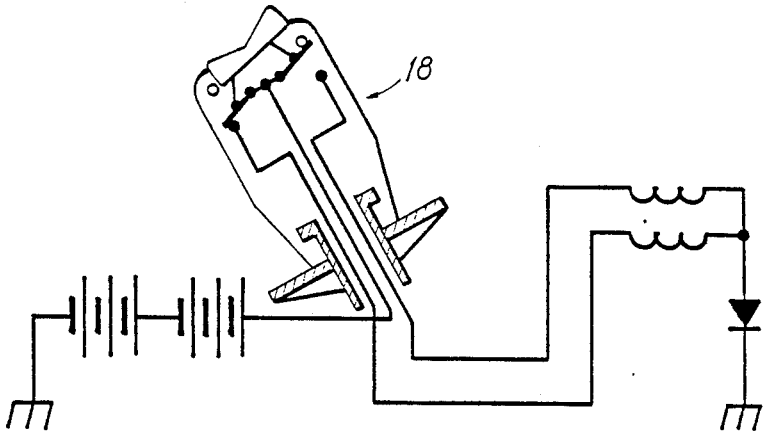
Figure 9:
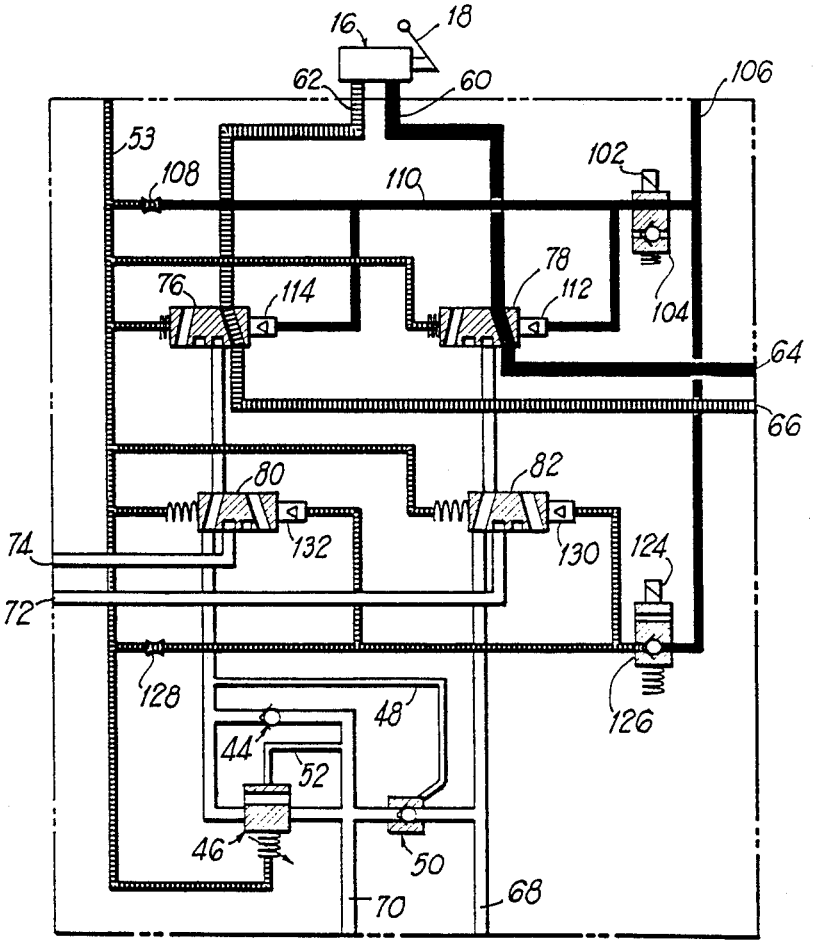
Figure 10A:
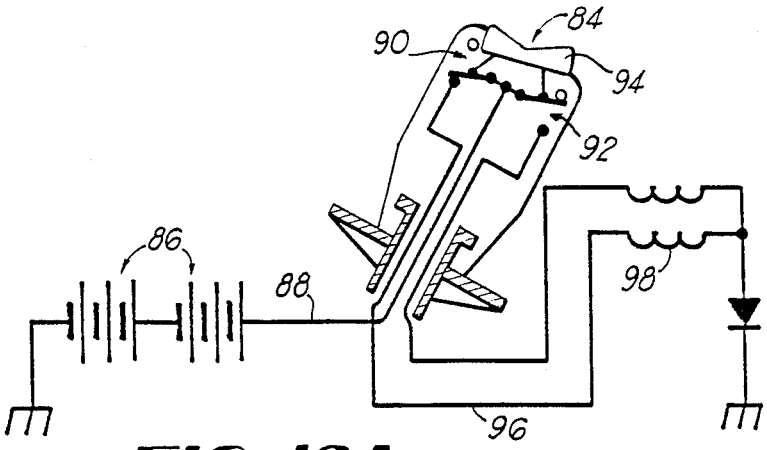
Figure 10:
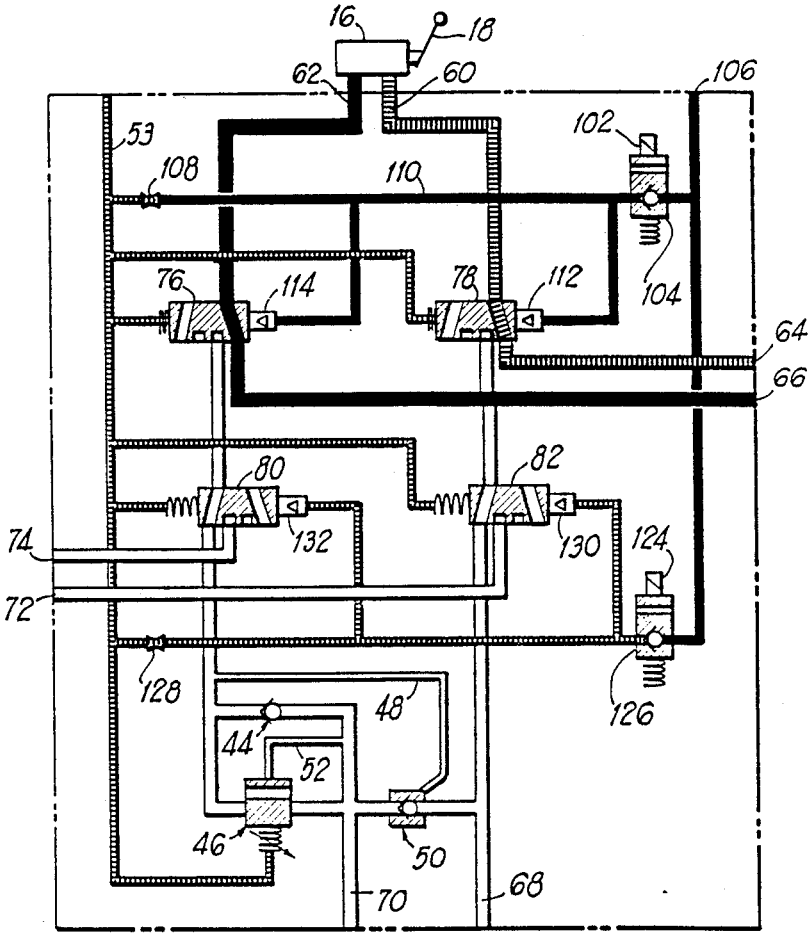
Figure 11A:
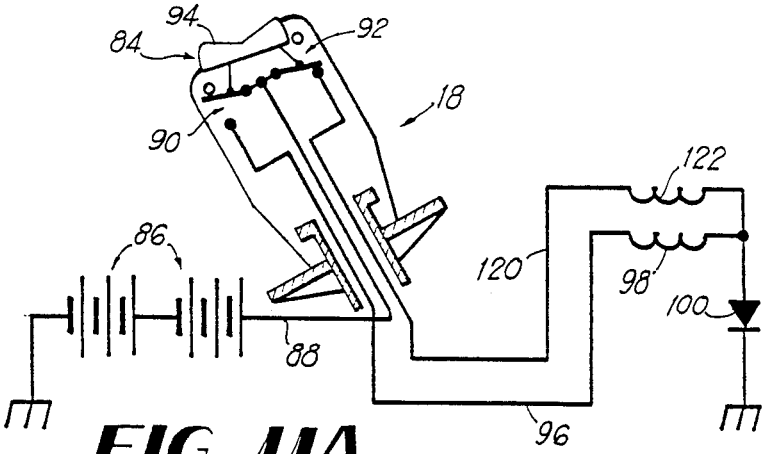
Figure 11:
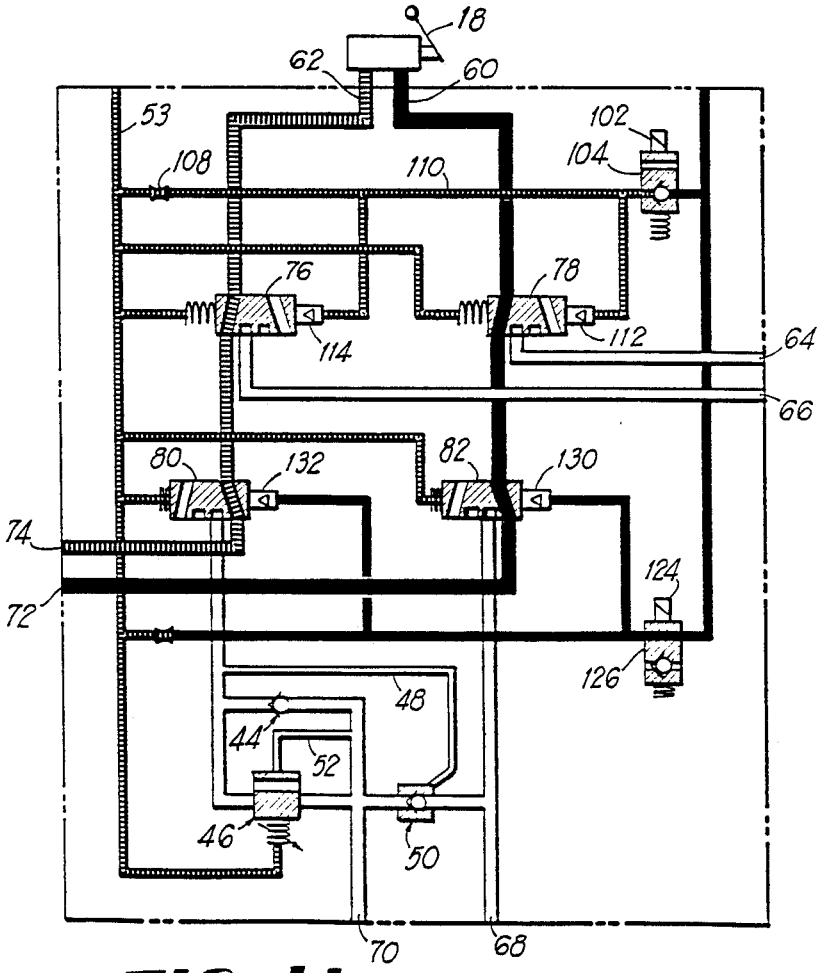
Figure 12A:
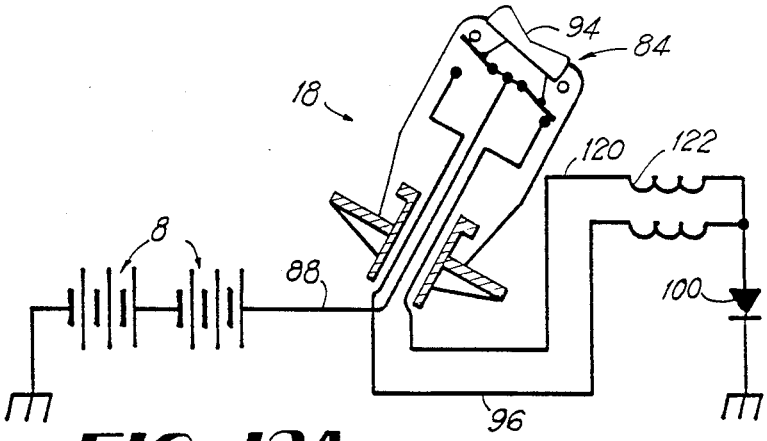
Figure 12:
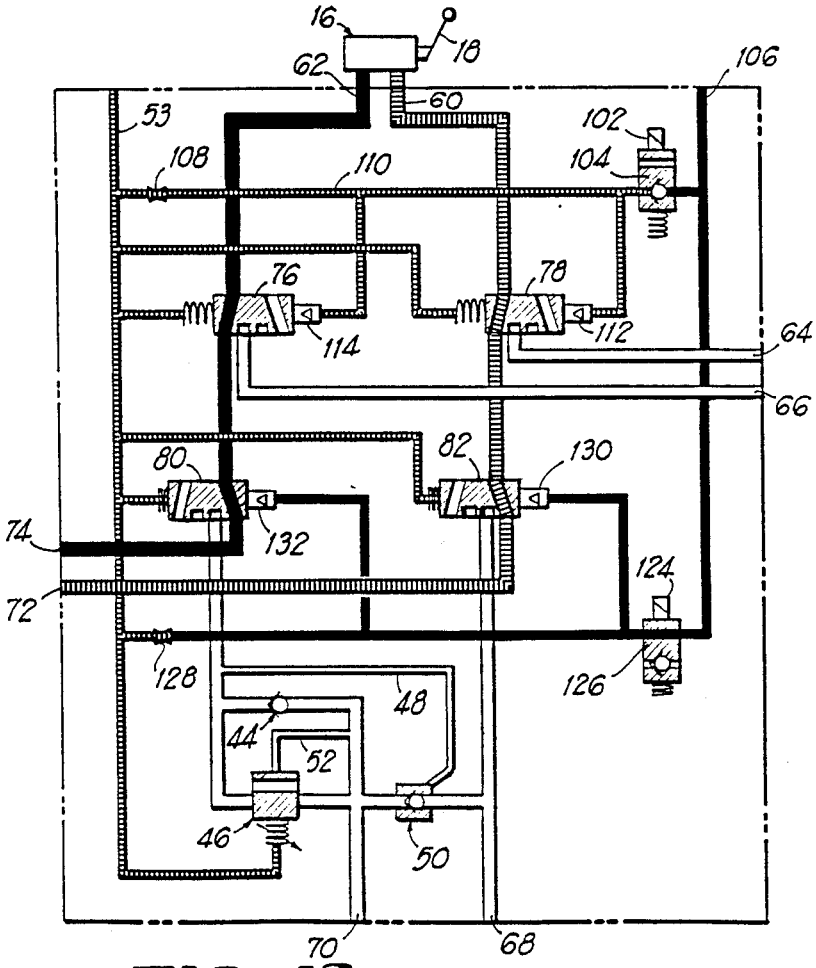

FIG. 4 ia a diagrammatic view of the embodiment of FIG. 1 illustrating the non-regenerative piston extending mode of operation;

FIG. 5 is a diagrammatic view illustrating another embodiment of the invention;

FIG. 6 is a diagrammatic view of the embodiment of FIG. 5 illustrating the piston retracting mode of operation for one of the piston/cylinder assemblies being served;

FIG. 6A illustrates the operator control position associated with FIG. 6;

FIG. 7 is a diagrammatic view illustrating the regenerative piston extending mode of operation related to FIG. 6;

FIG. 7A illustrates the operator control position associated with FIG. 7;

FIG. 8 is a diagrammatic view illustrating the non-regenerative piston extending mode of operation related to FIG. 6;

FIG. 8A illustrates the operator control position associated with FIG. 8;

FIG. 9 is a diagrammatic view corresponding to FIG. 6 but illustrating control of a second piston/cylinder assembly;

FIG. 9A illustrates the operator control position associated with FIG. 9;

FIG. 10 is a diagrammatic view corresponding to FIG. 8 but illustrating control of the second piston/cylinder assembly;

FIG. 10A illustrates the operator control position associated with FIG. 10;

FIG. 11 is a diagrammatic view corresponding with FIG. 9 but illustrating control of a third piston/cylinder assembly;

FIG. 11A illustrates the operator control position associated with FIG. 11;

FIG. 12 is a diagrammatic view corresponding with FIG. 10 but illustrating the control of the third piston/-cylinder assembly; and FIG. 12A illustrates the operator control position associated with FIG. 12.

DETAILED DESCRIPTION OF THE INVENTION

FIG. 1 illustrates one embodiment of the invention and the hydraulic system associated therewith. As shown, the hydraulic system includes the source or pump P having the inlet line 10 and the outlet line 12. The inlet line picks up hydraulic fluid from the reservoir 14 and the pump delivers the fluid under the requisite pressure to the operator-controlled valve 16. The usual pressure relief valve for the pump is not illustrated for clarity but it will be understood that all of the usual elements of the normal hydraulic system will be provided as will be understood by those of ordinary skill in the art. The operator-controlled valve may of any conventional form and is provided with a control handle 18 which may be moved from the neutral position shown to either of the noraml control positions. In one control position, the pressure line 12 is connected to the outlet 20 while the second outlet 22 is connected to drain, i.e., to the reservoir 14 via the drain line 13. In the other control position, the connections are reversed so that the outlet 22 is connected to the pressure line 12 and the outlet 20 is connected to the drain line 13.

The basic control unit of this embodiment of the invention serves the piston/cylinder assembly 24 which includes the cylinder 26 within which the piston 28 operates and from which projects the piston rod 30 for operating an associated device. The assembly is provided with a base end connection 32 and a rod end connection 34 in the usual configuration of a double acting assembly as will be understood by those of ordinary skill in the art.

The control unit is provided with a first fluid inlet port 36 and a second fluid inlet port 38. The control unit may be conditioned so that these two ports are disconnected from both fluid pressure and drain; the first inlet port is connected to pressurized fluid while the second inlet port is connected to drain; or the second inlet port is connected to pressurized fluid while the first inlet port is connected to drain, dependent upon the position of the control valve 16. At the outlet side of the control unit, the first fluid outlet port 40 is connected with the base end connection 32 of the double acting piston/cylinder assembly 24 whereas the second fluid outlet port 42 is connected with the rod end of the assembly. From FIG. 1, it will be evident that there is a direct fluid flow path means established between the first fluid inlet port 36 and the base end of the double acting piston/cylinder assembly 24 so that whenever the first fluid inlet port is connected to pressurized fluid, the base end of the assembly 24 will be pressurized to extend the piston 28 and its rod 30. Likewise, when the first inlet port 20 is connected to drain, the base end of the assembly 24 is directly connected to drain. The importance of this arrangement will become evident as this description proceeds.

Figure 2:
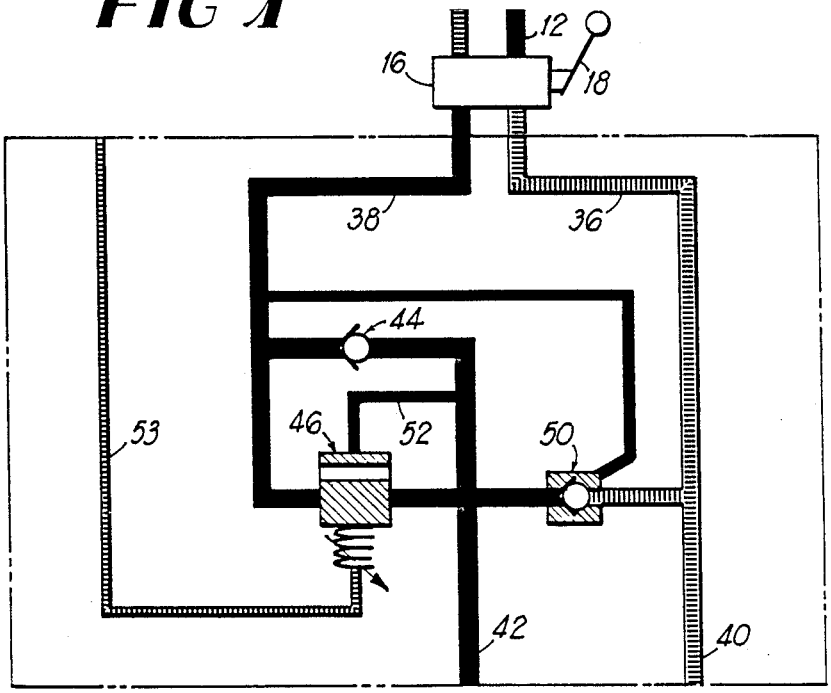
FIG. 2 is a diagrammatic view of the embodiment of FIG. 1 illustrating the piston retracting mode of operation.

The control unit includes second fluid flow path means between the inlet port 38 and the outlet port 42. When the inlet port 38 is connected with pressurized fluid, this second fluid flow path means is through the check valve 44 and allows the pressurized fluid to flow to the rod end of the assembly 24 while fluid being expelled from the base end of the piston/cylinder assembly 24 flows through the first fluid flow path means from the base end of the assembly 24 directly to drain. This condition is illustrated in FIG. 2. From this Figure, it will be seen that the fluid under pressure flows from the second inlet port 38, through the check valve 44 to the outlet port 42 to pressurize the rod end of the assembly 24 causing the fluid in the base end thereof to be expelled through the outlet port 40 to the inlet port 36 and drain. That branch of the second fluid flow path means containing the pressure responsive valve 46 will be blocked and the pressure in the pilot line 48 controls the pilot controlled check valve 50 to remain closed so that the third fluid flow path means containing this valve 50 is inoperative at this time. The condition of FIG. 2 is established by the operator upon manipulating the control valve handle 18 to the position illustrated in FIG. 2 and serves to retract the piston rod 30. The device operated by the assembly may be, for example, the cutting shears of a tree cutter and the condition of FIG. 2 would operate to open the cutter blade assembly preparatory to receiving the trunk of a tree for subsequent cutting action.

Figure 3:
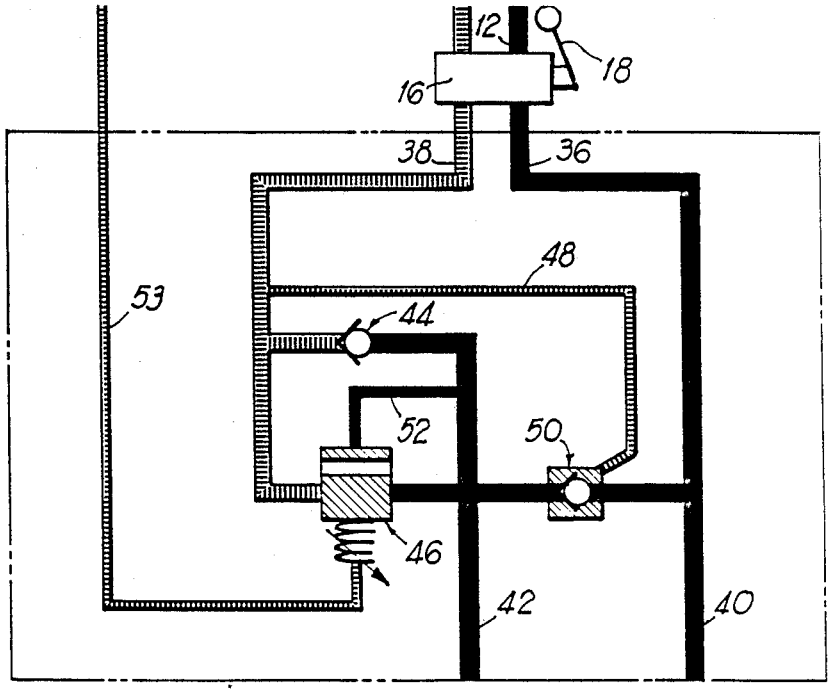
FIG. 3 is a diagrammatic view of the embodiment of FIG. 1 illustrating the regenerative piston extending mode of operation.

When the cutter blade assembly has been opened sufficiently the operator returns the handle 18 to neutral position as in FIG. 1, manipulates the tractor or other equipment to place a tree in the grasp of the cutter blade assembly, and then manipulates the handle to the position of FIG. 3. The hydraulic condition of FIG. 3 will prevail until the cutter blade assembly closes upon the tree and sufficient pressure builds up due to resistance to movement of the piston 28, to automatically open the pressure responsive valve 46. As shown, the second fluid inlet port 38 is connected with drain, whereas the first fluid inlet port 36 is connected with pressurized fluid directly to pressurize the base end of the piston/-cylinder assembly 24 and expel fluid from the rod end of the assembly. The fluid being expelled from the rod end of the piston/cylinder assembly is blocked by that portion of the second fluid flow path means containing the check valve 44 and is also blocked by that portion of the second fluid flow path means containing the pressure responsive valve 46. However, since the pilot line 48 of the pilot controlled check valve 50 is at drain pressure at this time, the fluid being expelled is free to flow through the third fluid flow path means from the rod end into the base end of the piston/cylinder assembly 24 in the well known regenerative fashion. This operates to extend the rod 30 in high speed/low force fashion.

When the cutter blade assembly engages the tree the pressure at the rod end of the assembly begins to rise suddenly and this increased pressure is transmitted to the pressure responsive valve 46 at the pilot line 52 and functions, at a predetermined and set pressure, automatically to open this valve and dump the rod end pressure directly to drain. In this way, the regenerative mode of operation is automatically terminated and transposition to non-regenerative mode is effected with substantially no back pressure at the rod end of the piston/cylinder assembly 24. In order to assure this effect, the valve 46 must be of the type which allows substantially unrestricted flow when it has been opened. For this purpose, it is preferred that the valve 46 be a model SOHB "kick down sequence valve" available from Sun Hydraulics Corp. A valve of this type is adjustable as to setting at which the valve will effect the transition from closed to open mode, and it is preferred that such valve be set at about 1700 psi for systems of this invention which are employed with tractors having a maximum of about 3000 psi capability. With valves of this type, once the set pressure has been attained and the valve has kicked down to the open position, the valve will remain in the open condition until the pilot line 52 is subjected to positive pressure as occurs when the condition of FIG. 2 is reestablished. The pilot fluid drain line 53 for the valve 46 is connected to system drain as is shown in FIG. 1.

The non-regenerative mode of operation is illustrated in FIG. 4. As shown, the valve 46 is in open condition due to attainment of the set pressure in the pilot line 52 when operating in the regenerative mode of FIG. 3. The normal action of the check valve 50 prevents back flow of fluid from the base end to the rod end of the piston/cylinder assembly 24 or, as stated otherwise, the third fluid flow path means is effective only as a one way path from the rod end to the base end of the assembly 24. The non-regenerative mode of operation is a low speed/high force mode which, because of the substantial absence of back pressure at the rod end of the piston/cylinder assembly, allows substantially the full available hydraulic pressure to be utilized for useful work.

A modified hydraulic system and control unit of this invention is illustrated in FIGS. 5–12A. With reference to FIG. 5, the control valve 16 is employed as in the above described Figures, operating as described but in this instance selectively to service one of three different piston/cylinder assemblies. For this purpose, the control unit is provided with two inlet ports 60 and 62 and with three pairs of outlet ports 64, 66; 68, 70; and 72, 74. The selection of which pair of outlet ports is to be served is made by the operator, as will presently be apparent. The selection involves the several spool valves 76, 78, 80, and 82. In the normal positions of these valves, shown in FIG. 5, a fluid flow path means is established from the inlet port 60 to the outlet port 68 which is connected to the base end of the double acting piston/cylinder assembly as in FIGS. 1–4. Likewise, the second fluid flow path means between the inlet port 62 and the oulet port 70 is established through the check valve 44 and through the sequence valve 46 as was described above, and the third fluid flow path means also is provided between the two outlets 68 and 70 through the pilot controlled check valve 50.

When the operator's handle or stalk 18 is manipulated to the position of FIG. 6A, pressurized fluid is connected to the second fluid flow path means as is indicated in FIG. 6, thereby to pressurize the rod end of the double acting piston/cylinder assembly and operate it in the high speed, shear-opening mode as was described in conjunction with FIG. 2. When the shear assembly has been opened the desired amount, the stalk 18 is returned to the neutral position and the tractor or the like maneuvered to position the shear assembly in operative relation to the tree desired to be cut, whereupon the handle 18 is moved to the position shown in FIG. 7A. This pressurizes the inlet port 60 and connects the inlet port 62 to drain, exactly as was described in conjunction with FIG. 3 to operate the piston-cylinder assembly in the regenerative mode. Because of the presence of the sequence valve 46, the transition from the regenerative mode to the non-regenerative mode, shown in FIG. 8 is effected automatically when the set pressure of the valve 46 is reached at the rod end of the piston/cylinder assembly, the handle 18 having remaining in the same position as it was in FIG. 7A, see FIG. 8A.

When the hydraulic piston/cylinder assembly served by the outlet ports 64, 66 is chosen for operation, the operator simultaneously positions the handle 18 and operates the switch mechanism 84 as shown in FIG. 9A. The switch mechanism is provided with a voltage/current source 86 having the conductor 88 connected in common with the two switches 90 and 92. In the position of the switch lever 94 as in FIG. 10A, the switch 90 is closed so that its conductor 96 energizes the solenoid winding 98. The diode 100 is provided for protective purposes. the winding 98 is part of the solenoid 102 which controls the pilot fluid valve 104 to open it and thereby connect the pilot fluid pressure supply line 106 to the drain line 53 through the restrictor 108. The supply line 106 is externally connected to a suitable source of hydraulic fluid pressure. The flow restrictor 108 operates to assure that the drain line remains substantially at the drain pressure while the upstream section 110 of the pilot line between the restrictor and the valve 104 is at at the requisite pilot fluid pressure. The hydraulic actuators 112 and 114 cause the pilot operated valves 76 and 78 to move to the positions shown in FIG. 9 to connect the inlet port 60 to the outlet port 64 and the inlet port 62 to the outlet port 66. If, now, the assembly served by the outlet ports 64 and 66 is desired to be operated in the opposite direction, the handle 18 must be manipulated to the position shown in FIG. 10A while the switch lever is in the same position as described for FIG. 9A. The positions of the valves 76 and 78 will not change but the pressure/drain connections for the inlet ports 60 and 62 will be reversed as illustrated in FIG. 10.

FIGS. 11–12A illustrate the positions for the handle and the switch lever 94 which control the assembly served by the outlet ports 72 and 74. The only difference between these Figures and FIGS. 9–10A is that the switch lever 94 is now in the position to close the switch 92 so as to energize the solenoid winding 122 associated with the solenoid 124 for operating the valve 126. Under this condition, the valve 126 is opened to connect the pilot pressure line 106 to the drain line 53 through the restrictor 128 to operate the flow direction control valves 80 and 82 to the positions shown in FIGS. 11 and 12. Thus, the outlet port 72 is connected to the inlet port 60 and the outlet port 74 is connected to the inlet port 62, the pressure/drain connections to these inlet ports being controlled by the position of the handle 18 (FIGS. 11A and 12A).

While an embodiment of a directional control valve and a regeneration valve in a control circuit and modifications thereof have been shown and described in detail herein, various other changes and modifications may be made without departing from the scope of the present invention.

What is claimed is:

1. A system having a plurality of double acting hydraulic piston/cylinder assemblies which are to be operated individually and at selected times, comprising the combination of:

an operator-controlled valve adapted to be connected both to a source of pressurized hydraulic fluid and to drain therefor, and having first and second outlets respectively connected to the source and drain in one position of the operator-controlled valve and vice versa in another position of the operator-controlled valve;

a control unit including first and second fluid inlet ports connected respectively to said first and second outlets to receive pressurized fluid at said first inlet port while said second fluid inlet port is connected to drain, and vice versa, dependent upon the position of said operator-controlled valve;

said control unit also including first and second fluid outlet ports adapted to supply the base end and the rod end of a first double acting piston/cylinder assembly respectively with pressurized fluid and drain connection, and vice versa, dependent upon the position of said operator-controlled valve;

said control unit further including third and fourth fluid outlet ports adapted to supply the base end and the rod end of a second double acting piston/-cylinder assembly respectively with pressurized fluid and drain connection, and vice versa, dependent upon the position of said operator-controlled valve; and said control unit including directional flow control valve means for selectively blocking flow from said first and second inlet ports either to said first and second outlet ports or to said third and fourth outlet ports, said flow control valve means comprising pilot fluid controlled valve means for normally allowing flow only from said first and second fluid inlet ports to said first and second outlet ports, a pilot fluid pressure line and a pilot fluid drain line, and solenoid operated valve means for allowing said pilot fluid pressure line to communicate with said pilot fluid drain line while actuating said pilot fluid controlled valve means to allow flow only from said first and second inlet ports to said third and fourth outlet ports.

2. A system as defined in claim 1 including fluid pressure responsive means connecting said second fluid outlet port to said first fluid outlet port for allowing fluid under pressure to flow from said second fluid outlet port to said first fluid outlet port to effect a regenerative fluid flow to and from the piston-cylinder assembly served by said first and second outlet ports; and fluid responsive means for allowing said second fluid outlet port to be connected to drain at said second fluid inlet port in response to a predetermined pressure of fluid at said second fluid outlet port so as automatically to transpose to non-regenerative fluid flow to and from the piston/cylinder assembly served by said first and second outlet ports.

3. A control unit for hydraulic circuits adapted to receive the reversible pressure/drain hydraulic fluid outputs of a manual control valve and to supply at least one double-acting hydraulic piston/cylinder assembly, said control unit including first fluid flow path means for directly connecting the base end of a supplied piston/cylinder assembly alternatively to pressurized fluid and to drain dependent upon the controlled position of the manual control valve, second fluid flow path means for connecting the rod end of the supplied piston/cylinder assembly alternatively to pressurized fluid and to drain dependent upon the controlled position of the manual control valve, third flow path means for connecting the rod end to the base end of the supplied piston/cylinder assembly, and pressure responsive valve means in said second and said third flow path means for automatically transposing operation of the supplied piston/cylinder assembly from a regenerative, high speed, low force mode to a non-regenerative, high force, low speed mode when said first flow path means is supplied with pressurized fluid and said second flow path means is connected to drain, said pressure responsive valve means including a pressure sensitive valve in said second fluid flow path means, a pressure sensitive check valve in said third fluid flow path means, and a pilot line connecting the pressure sensitive check valve with said second fluid flow path means at a location between the pressure sensitive valve and the manual control valve.

4. In a hydraulic system for operating a piston/cylinder assembly in a compound extending mode of operation comprising an initial regenerative operation of the piston/cylinder assembly which automatically transposes to non-regenerative operation in response to attainment of predetermined resistance to operation of the piston/cylinder assembly, the combination of:

direct flow path means for extending and retracting the assembly;

regenerative fluid flow path means for allowing fluid to flow regeneratively under pressure between the ends of the piston/cylinder assembly; and pressure responsive valve means for automatically draining one end of the piston/cylinder assembly when the predetermined resistance to operation of the assembly is encountered so as to transpose to the non-regenerative operation, said pressure responsive valve means including a pressure sensitive valve in said direct flow path means, a parallel fluid flow path within said direct flow path means around said pressure sensitive valve, a pressure sensitive check valve in said parallel fluid flow path, and a pilot line connecting said parallel fluid flow path to said pressure sensitive valve, the check valve and the pilot line serving to regulate the pressure to said pressure sensitive valve.

5. In a hydraulic system for operating a piston/cylinder assembly in a compound mode of operation comprising an initial regenerative operation of the piston/-cylinder assembly which automatically transposes to non-regenerative operation in response to attainment of predetermined resistance to operation of the piston/cylinder assembly, the combination of:

an operator-controlled valve adapted to be connected both to a source of pressurized hydraulic fluid and to drain therefor, and having first and second outlets respectively connected to the source and drain in one position of the operator-controlled valve;

first fluid flow path means for directly connecting said first outlet to the base end of the piston/cylinder assembly in any position of said operator-controlled valve;

second fluid flow path means for normally blocking flow of fluid from the rod end of the piston/cylinder assembly;

third fluid flow path means connecting said rod end to said base end of the piston/cylinder assembly for allowing fluid to flow regeneratively under pressure from said rod end to said base end of the piston/cylinder assembly including a first check valve and a first pilot line connecting said first check valve to said second fluid flow path, said first check valve and said first pilot line rendering the third fluid flow path inoperative when the pressure in said first pilot line exceeds a selected value; and said second fluid flow path means including pressure responsive valve means, a second check valve and a second pilot line, said second check valve and said second pilot line regulating the pressure to said pressure responsive valve means, for connecting said rod end of the piston/cylinder assembly to drain in response to attainment of a set pressure at said rod end of the piston/cylinder assembly whereby automatically to effect the transition from the regenerative operation to the non-regenerative operation.

6. A hydraulic system for operating a double-acting piston/cylinder assembly in a single mode in that direction of operation in which the piston is being retracted and in a compound mode in the opposite direction of operation in which the piston is being extended, the compound mode being an initial regenerative operation of the piston/cylinder assembly which automatically transposes to non-regenerative operation in response to attainment of predetermined resistance to operation of the piston/cylinder assembly while the piston is being extended, comprising the combination of:

an operator-controlled valve adapted to be connected both to a source of pressurized hydraulic fluid and to drain therefor, and having first and second outlets respectively connected to the source and drain in one position of the operator-controlled valve and vice versa in another position of the operator-controlled valve;

first fluid flow path means connecting said first outlet directly to the base end of said double-acting piston/cylinder assembly for subjecting said base end of the piston/cylinder assembly to fluid pressure when the operator-controlled valve is in said one position and for connecting said base end of the piston/cylinder assembly to drain when the operator-controlled valve is in said another position;

second flow path means connecting said second outlet to the rod end of said double-acting piston/cylinder assembly for allowing pressurized fluid to flow from said second outlet to the rod end of the piston/cylinder assembly when said operator-controlled valve is in said another position and normally to block flow of fluid from the rod end of the piston/cylinder assembly to said second outlet when the operator-controlled valve is in said one position;

third flow path means connecting the rod and base ends of the piston/cylinder assembly for allowing fluid to flow regeneratively from the rod end to the base end when said operator-controlled valve is in said one position and for blocking flow between the rod end and the base end when said operator-controlled valve is in the another position;

said second flow path means including first pressure responsive valve means for connecting said rod end of the piston/cylinder assembly to said second outlet when said operator-controlled valve is in said one position and the pressure at said rod end of the piston/cylinder assembly has attained a set value whereby automatically to effect the transition from the regenerative operation to the non-regenerative operation, said first pressure responsive valve means including a pressure sensitive valve, a parallel flow path within said second flow path means around said pressure sensitive valve, a pressure sensitive check valve in said parallel flow path, and a pilot line connecting said parallel flow path to said pressure sensitive valve serving to regulate the pressure to said pressure sensitive valve.

7. A control unit as defined in claim 6 including third and fourth fluid outlet ports to serve a second piston/-cylinder assembly and controllable valve means for connecting said first and second inlet ports to said third and fourth outlet ports.

8. A control unit as defined in claim 7 including fifth and sixth fluid outlet ports to serve a third piston/cylinder compound mode in the opposite direction of operation in which the piston is being extended, the compound mode being an initial regenerative operation of the piston/cylinder assembly which automatically transposes to non-regenerative operation in response to attainment of predetermined resistance to operation of the piston/cylinder assembly while the piston is being extended, comprising the combination of:

an operator-controlled valve adapted to be connected both to a source of pressurized hydraulic fluid and to drain therefor, and having first and second outlets respectively connected to the source and drain in one position of the operator-controlled valve and vice versa in another position of the operator-controlled valve;

first fluid flow path means connecting said first outlet directly to the base end of said double-acting piston/cylinder assembly for subjecting said base end of the piston/cylinder assembly to fluid pressure when the operator-controlled valve is in said one position and for connecting said base end of the piston/cylinder assembly to drain when the operator-controlled valve is in said another position;

second flow path means connecting said second outlet to the rod end of said double-acting piston/cylinder assembly for allowing pressurized fluid to flow from said second outlet to the rod end of the piston/cylinder assembly when said operator-controlled assembly and second controllable valve means for connecting said first and second inlet ports to said fifth and sixth outlet ports.

9. A control unit as defined in claim 3 including third and fourth fluid outlet ports to serve a second piston/-cylidner assembly and controllable valve means for connecting said first and second inlet ports to said third and fourth outlet ports.

10. A control unit as defined in claim 9 including fifth and sixth fluid outlet ports to serve a third piston/cylinder assembly and second controllable valve means for connecting said first and second inlet ports to said fifth and sixth outlet ports.

11. A control unit as defined in claim 4 including third and fourth fluid outlet ports to serve a second piston/cylidner assembly and controllable valve means for connecting said first and second inlet ports to said third and fourth outlet ports.

12. A control unit as defined in claim 11 including fifth and sixth fluid outlet ports to serve a third piston/- cylinder assembly and second controllable valve means for connecting said first and second inlet ports to said fifth and sixth outlet ports.

13. A control unit as defined in claim 5 including third and fourth fluid outlet ports to serve a second piston/cylidner assembly and controllable valve means for connecting said first and second inlet ports to said third and fourth outlet ports.

14. A control unit as defined in claim 13 including fifth and sixth fluid outlet ports to serve a third piston/-cylinder assembly and second controllable valve means for connecting said first and second inlet ports to said fifth and sixth outlet ports.

* * * * *